US009039137B2

(12) United States Patent
Moriwaki et al.

(10) Patent No.: US 9,039,137 B2
(45) Date of Patent: May 26, 2015

(54) IMAGE FORMING APPARATUS

(71) Applicants: Yuta Moriwaki, Kanagawa (JP); Tomomi Katoh, Kanagawa (JP); Soyoung Park, Kanagawa (JP); Hiroshi Noda, Kanagawa (JP)

(72) Inventors: Yuta Moriwaki, Kanagawa (JP); Tomomi Katoh, Kanagawa (JP); Soyoung Park, Kanagawa (JP); Hiroshi Noda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/011,331

(22) Filed: Aug. 27, 2013

(65) Prior Publication Data

US 2014/0063121 A1 Mar. 6, 2014

(30) Foreign Application Priority Data

Sep. 1, 2012 (JP) ..... 2012-192712

(51) Int. Cl.
*B41J 2/165* (2006.01)
*B41J 29/02* (2006.01)

(52) U.S. Cl.
CPC ..... *B41J 29/02* (2013.01); *B41J 2/16505* (2013.01); *B41J 2/16508* (2013.01)

(58) Field of Classification Search
USPC ..... 347/32
See application file for complete search history.

(56) References Cited

U.S. PATENT DOCUMENTS 5,055,856 A * 10/1991 Tomii et al. ..... 347/30
2004/0017423 A1* 1/2004 Wotton et al. ..... 347/33
2008/0231653 A1 9/2008 Kawashima et al.
2009/0295872 A1* 12/2009 Ray et al. ..... 347/50
2010/0046031 A1* 2/2010 Silverbrook et al. ..... 358/1.15
2010/0225701 A1* 9/2010 Silverbrook ..... 347/42
2012/0056933 A1 3/2012 Tanaka et al.
2012/0081491 A1* 4/2012 Okumura ..... 347/108
2012/0133706 A1 5/2012 Park
2012/0224000 A1 9/2012 Park
2012/0224001 A1 9/2012 Park
2012/0320125 A1 12/2012 Katoh et al.
2013/0162718 A1 6/2013 Noda
2013/0182036 A1 7/2013 Park
2013/0194346 A1 8/2013 Moriwaki

FOREIGN PATENT DOCUMENTS

JP 3-290260 12/1991
JP 2005-169955 6/2005
JP 2006-175666 7/2006
JP 2007-534518 11/2007

(Continued)

OTHER PUBLICATIONS

U.S. Appl. No. 13/923,515, filed Jun. 21, 2013.

(Continued)

*Primary Examiner* — Stephen Meier
*Assistant Examiner* — Alexander D Shenderov
(74) *Attorney, Agent, or Firm* — Cooper & Dunham LLP

(57) ABSTRACT

An image forming apparatus includes an image forming part including a recording head to form an image on a recording medium, a conveyance mechanism disposed opposite the image forming part to convey the recording medium, and a cover closably openable relative to a body of the image forming apparatus and disposed opposite the conveyance mechanism with the image forming part interposed therebetween. The recording head is detachably attachable to the cover and is configured to move away from the conveyance mechanism when the cover is opened.

7 Claims, 7 Drawing Sheets

(56) References Cited

FOREIGN PATENT DOCUMENTS

| | | |
|---|---|---|
| JP | 2008-229970 | 10/2008 |
| JP | 2010-000809 | 1/2010 |
| JP | 2011-191792 | 9/2011 |
| JP | 2012-045796 | 3/2012 |
| JP | 2012-116055 | 6/2012 |
| JP | 2012-121147 | 6/2012 |
| JP | 2012-136034 | 7/2012 |
| WO | WO2005/070675 A1 | 8/2005 |

OTHER PUBLICATIONS

U.S. Appl. No. 13/937,301, filed Jul. 9, 2013.

* cited by examiner

IMAGE FORMING APPARATUS

CROSS-REFERENCE TO RELATED APPLICATION

This patent application is based on and claims priority pursuant to 35 U.S.C. §119 to Japanese Patent Application No. 2012-192712, filed on Sep. 1, 2012, in the Japan Patent Office, the entire disclosure of which is hereby incorporated by reference herein.

BACKGROUND

1. Technical Field

Exemplary aspects of the present invention generally relate to an image forming apparatus.

2. Related Art

Like a printer, copier, plotter, facsimile machine, or multi-function device having two or more of these capabilities, an inkjet recording device employing a liquid ejection recording method is also a type of image forming apparatus. Typically, the inkjet recording device includes a recording head constructed of a liquid ejection head that ejects droplets of a recording liquid such as ink onto a sheet of a recording medium to form an image on the sheet.

JP-2012-116055-A discloses an inkjet-type image forming apparatus that includes an image forming part and a conveyance mechanism. The image forming part includes a recording head that ejects droplets in a horizontal direction, and the conveyance mechanism is disposed opposite the image forming part to convey a recording medium past the image forming part. The conveyance mechanism is uncovered along with movement of a closably openable cover provided to the image forming apparatus. As a result, a conveyance path, through which the recording medium is conveyed, is exposed outside, thereby facilitating fixing of sheet jams in the conveyance path.

However, although facilitating the fixing of sheet jams, the above-described configuration hinders easy replacement of the recording head included in the image forming part with a new recording head.

SUMMARY

In view of the foregoing, illustrative embodiments of the present invention provide a novel image forming apparatus that facilitates fixing of sheet jams and replacement of a recording head.

In one illustrative embodiment, an image forming apparatus includes an image forming part including a recording head to form an image on a recording medium, a conveyance mechanism disposed opposite the image forming part to convey the recording medium, and a cover closably openable relative to a body of the image forming apparatus and disposed opposite the conveyance mechanism with the image forming part interposed therebetween. The recording head is detachably attachable to the cover and is configured to move away from the conveyance mechanism when the cover is opened.

In another illustrative embodiment, an image forming apparatus includes an image forming part including a recording head to form an image on a recording medium, a conveyance mechanism disposed opposite the image forming part to convey the recording medium, a cover closably openable relative to a body of the image forming apparatus and disposed opposite the conveyance mechanism with the image forming part interposed therebetween, and a head supporter movable in conjunction with opening and closing of the cover. The recording head is detachably attachable to the head supporter, and the head supporter is configured to, when the cover is opened, move in a direction in which the recording head is configured to move away from the conveyance mechanism.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
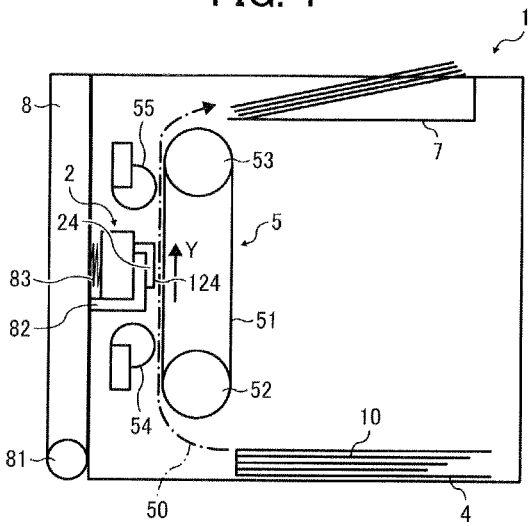
FIG. 1 is a schematic vertical cross-sectional view illustrating an example of a configuration of an image forming apparatus according to a first illustrative embodiment in a state in which a cover is closed.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a "sheet" of recording media is not limited to a sheet of paper but also includes any material onto which ink droplets, liquid, an image forming agent, or the like adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting droplets onto the recording medium. In this specification, an image refers to both signifying images such as characters and figures, as well as a non-signifying image such as patterns.

In addition, ink includes any material which is a liquid when ejected from the image forming apparatuses to form images on the recording medium, such as a DNA sample, a resist material, a pattern material, and resin.

Further, an image formed on the recording medium is not limited to a flat image, but also includes an image formed on a three-dimensional object, a three-dimensional image, and so forth.

Herein, the term "horizontal" that refers to a direction of ejection of droplets includes a direction other than the vertical, such as a direction slanted upward or downward with respect to the horizontal, and the term "vertical" that refers to a direction of conveyance of a recording medium includes a direction other than the horizontal, such as a direction slanted upward or downward with respect to the vertical.

Figure 2:
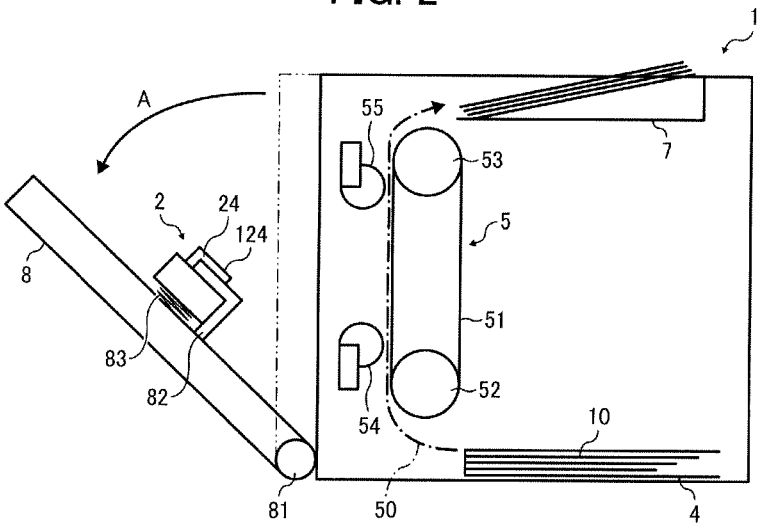
FIG. 2 is a schematic vertical cross-sectional view of the image forming apparatus illustrated in FIG. 1 in a state in which the cover is opened.

A description is now given of a configuration and operation of an image forming apparatus 1 according to a first illustrative embodiment, with reference to FIGS. 1 and 2.

FIG. 1 is a schematic vertical cross-sectional view illustrating an example of a configuration of the image forming apparatus 1 according to the first illustrative embodiment in a state in which a cover 8 is closed. FIG. 2 is a schematic vertical cross-sectional view of the image forming apparatus 1 illustrated in FIG. 1 in a state in which the cover 8 is opened.

The image forming apparatus 1 is a line-type inkjet recording device and includes an image forming part 2 and a conveyance mechanism 5 within a body thereof. A sheet feeder 4 such as a sheet feed tray or a sheet feed cassette is disposed in a lower part of the image forming apparatus 1. The sheet feeder 4 accommodates a stack of multiple recording media such as sheets 10.

The sheet 10 fed from the sheet feeder 4 is conveyed in a vertical direction to the image forming unit 2 by the conveyance mechanism 5, so that the image forming unit 2 ejects droplets horizontally onto the sheet 10 to form an image on the sheet 10. The sheet 10 having the image thereon is then further conveyed upward and is discharged to a discharge tray 7 provided in an upper part of the image forming apparatus 1.

The image forming apparatus 1 further includes the cover 8 closably openable relative to the body of the image forming apparatus 1. The cover 8 is disposed opposite the conveyance mechanism 5 with the image forming part 2 interposed therebetween. In the present illustrative embodiment, the cover 8 is provided to a front side of the image forming apparatus 1.

The image forming part 2 includes a recording head 24 constituted of a line-type liquid ejection head that ejects ink droplets of specific colors, that is, yellow (Y), magenta (M), cyan (C), and black (K). It is to be noted that, examples of the line-type liquid ejection head include a full-line type liquid ejection head and an array-type liquid ejection head in which multiple liquid ejection heads are arranged in a staggered pattern in a direction of nozzle arrays perpendicular to a direction of conveyance of the sheet 10 (hereinafter also referred to as a sheet conveyance direction) indicated by arrow Y in FIG. 1. In addition, although the recording head 24 is constructed of the liquid ejection head in the present illustrative embodiment, the configuration of the recording head 24 is not limited thereto.

Each end of the recording head 24 in a direction perpendicular to the sheet conveyance direction is held by a head holder 82 provided to the cover 8 such that the recording head 24 is detachably attachable to the head holder 82.

A pressing part that presses the recording head 24 toward a direction of ejection of droplets, which, in the present illustrative embodiment, is an elastic member 83, is provided between the cover 8 and a rear face of the recording head 24 opposite a nozzle face 124 of the recording head 24 to keep the orientation of the recording head 24 relative to the conveyance mechanism 5.

The conveyance mechanism 5 includes an endless conveyance belt 51 wound around a drive roller, that is, a conveyance roller 52, and a driven roller 53. The conveyance roller 52 is rotatively driven by a sheet feeding motor, not shown, via a timing belt and a timing pulley to rotate the conveyance belt 51 in the sheet conveyance direction, so that the sheet 10 is conveyed upward while facing the recording head 24 of the image forming part 2.

Spurs 54 and 55 that press the sheet 10 are disposed upstream and downstream from the recording head 24 in the sheet conveyance direction, respectively.

It is to be noted that, alternatively, the sheet feeder 4 may be disposed in the upper part of the image forming apparatus 1 and the discharge tray 7 may be disposed in the lower part thereof. In such a configuration, an image is formed on the sheet 10 while the sheet 10 is conveyed downward by the conveyance mechanism 5.

The cover 8 is hingedly supported by a support shaft 81 provided at the bottom of the image forming apparatus 1 to be swung open and closed. Thus, the cover 8 is swingable between a closed position illustrated in FIG. 1 and an open position illustrated in FIG. 2.

Upon fixing of sheet jams, the cover 8 is pulled forward in a direction of opening of the cover 8 indicated by arrow A in FIG. 2 to be swung open to the open position. Accordingly, the image forming part 2 including the recording head 24 is moved, together with the cover 8, away from the conveyance belt 51 of the conveyance mechanism 5 along with the opening of the cover 8, so that a conveyance path 50 formed between the recording head 24 and the conveyance belt 51 within the body of the image forming apparatus 1 is uncovered. As a result, sheets jammed at the conveyance belt 51 are easily removed from the conveyance path 50. After the fixing of sheet jams, the cover 8 is closed as illustrated in FIG. 1.

Figure 3A:
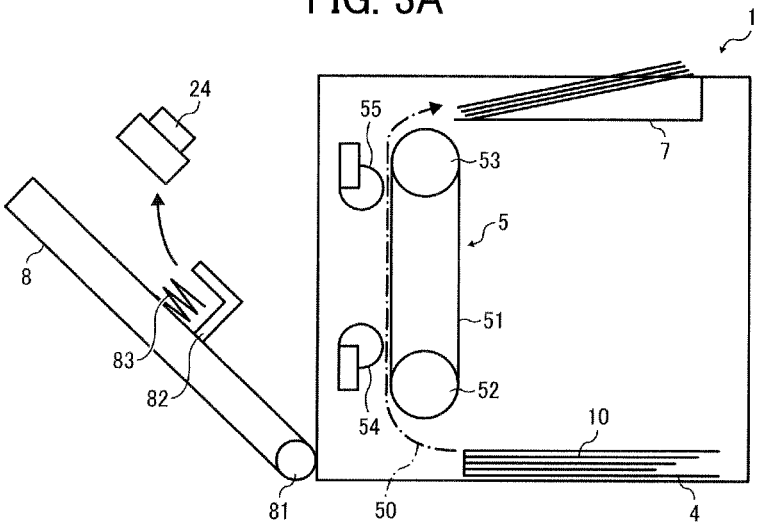
FIGS. 3A and 3B are schematic vertical cross-sectional views respectively illustrating steps in a process of replacing a recording head with a new recording head.
Figure 3B:
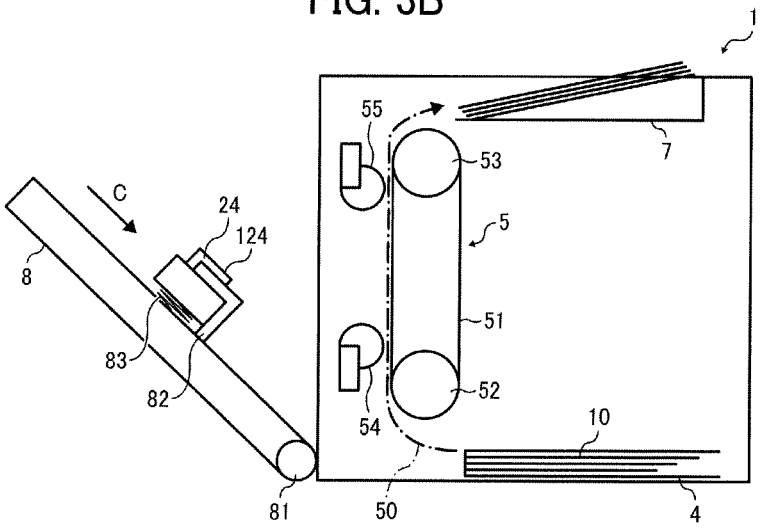

A description is now given of replacement of the recording head 24 with a new recording head 24, with reference to FIGS. 3A and 3B.

FIGS. 3A and 3B are schematic vertical cross-sectional views respectively illustrating steps in a process of replacing the recording head 24.

First, in a manner similar to the fixing of sheet jams described above, the cover 8 is pulled forward to be swung open to the open position. Next, the recording head 24 is detached from the head holder 82 provided to the cover 8 as illustrated in FIG. 3A. Thereafter, a new recording head 24 is attached to the head holder 82 from a direction indicated by arrow C in FIG. 3B.

In a state in which the cover 8 is at the open position, the recording head 24 attached to the head holder 82 is slightly movable relative to the head holder 82. When the cover 8 is closed, it is preferable that the recording head 24 be positioned relative to the body of the image forming apparatus 1 by being pressed against a positioning member provided to the body of the image forming apparatus 1 by the elastic member 83 provided to the cover 8. In such a case, it is preferable that a positioning member be provided to each of the body of the image forming apparatus 1 and the recording head 24 to position the recording head 24 within the body of the image forming apparatus 1 in the direction of nozzle arrays, the direction of ejection of droplets, and the sheet conveyance direction, and a pressing part including an elastic member or the like be provided to press the positioning members against each other.

Figure 4:
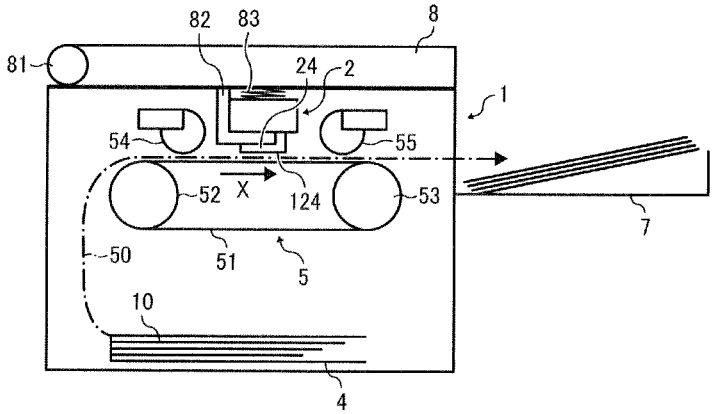
FIG. 4 is a schematic vertical cross-sectional view illustrating an example of a configuration of an image forming apparatus according to a second illustrative embodiment in a state in which a cover is closed.
Figure 5:
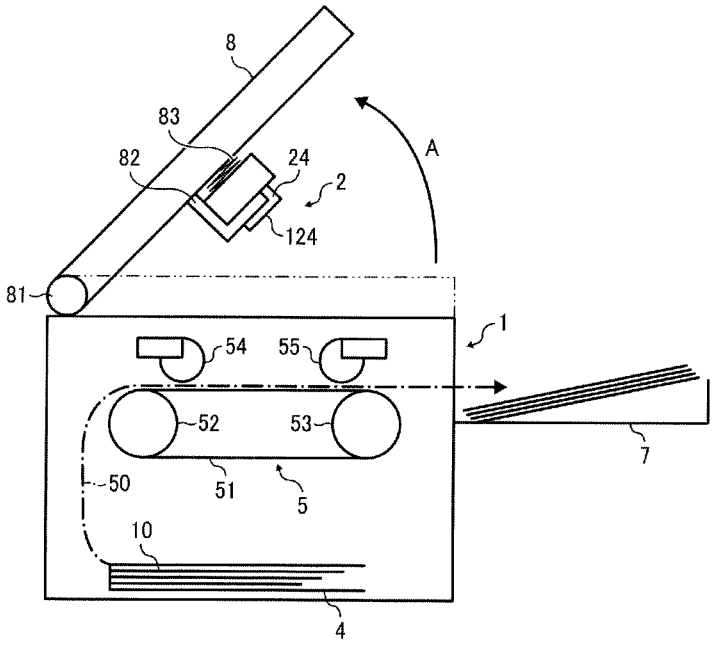
FIG. 5 is a schematic vertical cross-sectional view of the image forming apparatus illustrated in FIG. 4 in a state in which the cover is opened.

A description is now given of the image forming apparatus 1 according to a second illustrative embodiment, with reference to FIGS. 4 and 5.

FIG. 4 is a schematic vertical cross-sectional view illustrating an example of a configuration of the image forming apparatus 1 according to the second illustrative embodiment in the state in which the cover 8 is closed. FIG. 5 is a schematic vertical cross-sectional view of the image forming apparatus 1 illustrated in FIG. 4 in the state in which the cover 8 is opened.

In the second illustrative embodiment, the cover 8 is provided to the top of the image forming apparatus 1 and the sheet 10 is conveyed by the conveyance mechanism 5 in the horizontal direction as indicated by arrow X in FIG. 4 while facing the recording head 24. The recording head 24 ejects droplets downward onto the sheet 10 conveyed by the conveyance mechanism 5 to form an image on the sheet 10.

In the configuration of the second illustrative embodiment described above, the conveyance path 50 is uncovered when the cover 8 is opened upward as illustrated in FIG. 5, thereby allowing easy fixing of sheet jams and replacement of the recording head 24.

Figure 6:
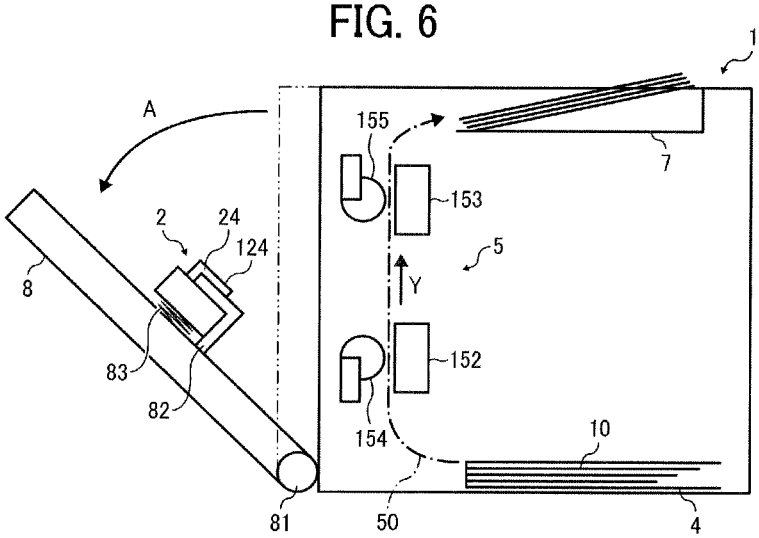
FIG. 6 is a schematic vertical cross-sectional view illustrating an example of a configuration of an image forming apparatus according to a third illustrative embodiment in a state in which a cover is opened.

A description is now given of the image forming apparatus 1 according to a third illustrative embodiment, with reference to FIG. 6.

FIG. 6 is a schematic vertical cross-sectional view illustrating an example of a configuration of the image forming apparatus 1 according to the third illustrative embodiment in the state in which the cover 8 is opened.

In the third illustrative embodiment, the conveyance mechanism 5 that conveys the sheet 10 is constructed of a first platen 152 and a first roller (or spur) 154, both of which are disposed upstream from the image forming part 2 in the sheet conveyance direction, and a second platen 153 and a second roller (or spur) 155, both of which are disposed downstream from the image forming part 2. The rest of the configuration of the third illustrative embodiment is substantially the same as the configuration of the first illustrative embodiment.

The image forming apparatus 1 according to the third illustrative embodiment achieves the same effects as those achieved by the first or second illustrative embodiment described previously.

Figure 7:
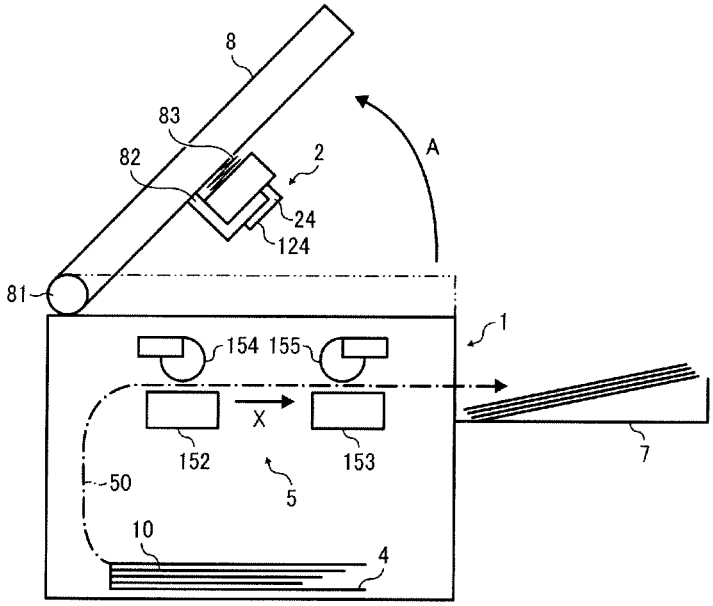
FIG. 7 is a schematic vertical cross-sectional view illustrating an example of a configuration of an image forming apparatus according to a fourth illustrative embodiment in a state in which a cover is opened.

A description is now given of the image forming apparatus 1 according to a fourth illustrative embodiment, with reference to FIG. 7.

FIG. 7 is a schematic vertical cross-sectional view illustrating an example of a configuration of the image forming apparatus 1 according to the fourth illustrative embodiment in the state in which the cover 8 is opened.

In the fourth illustrative embodiment, the conveyance mechanism 5 according to the third illustrative embodiment is employed in the configuration of the image forming apparatus 1 according to the second illustrative embodiment.

The image forming apparatus 1 according to the fourth illustrative embodiment achieves the same effects as those achieved by the first, second, or third illustrative embodiment described above.

Figure 8:
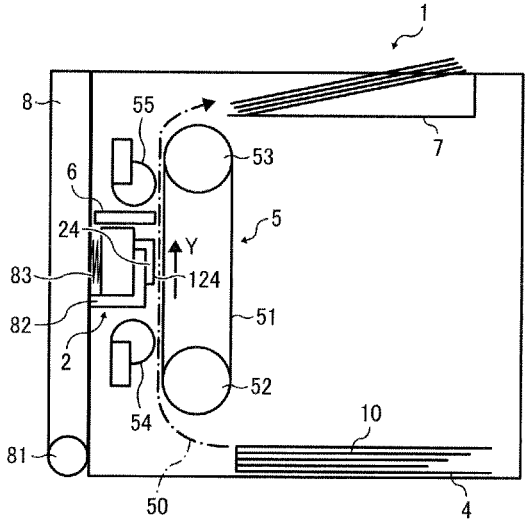
FIG. 8 is a schematic vertical cross-sectional view illustrating an example of a configuration of an image forming apparatus according to a fifth illustrative embodiment in a state in which a cover is closed.
Figure 9:
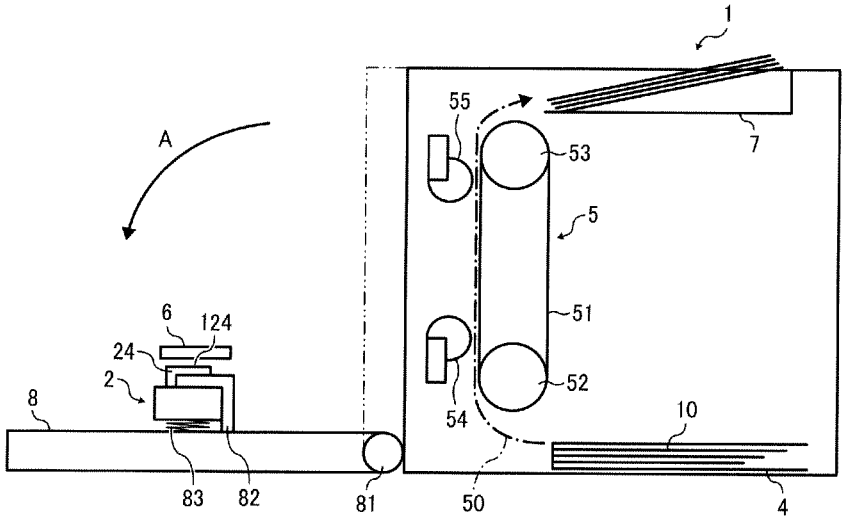
FIG. 9 is a schematic vertical cross-sectional view of the image forming apparatus illustrated in FIG. 8 in a state in which the cover is opened.

A description is now given of the image forming apparatus 1 according to a fifth illustrative embodiment, with reference to FIGS. 8 and 9.

FIG. 8 is a schematic vertical cross-sectional view illustrating an example of a configuration of the image forming apparatus 1 according to the fifth illustrative embodiment in the state in which the cover 8 is closed. FIG. 9 is a schematic vertical cross-sectional view of the image forming apparatus 1 illustrated in FIG. 8 in the state in which the cover 8 is opened.

In the fifth illustrative embodiment, a protection member that covers the nozzle face 124 of the recording head 24 when the cover 8 is opened, which, in the present illustrative embodiment, is a shutter member 6, is further provided to the image forming apparatus 1. The rest of the configuration of the image forming apparatus 1 according to the fifth illustrative embodiment is substantially the same as the configuration of the image forming apparatus 1 according to the first illustrative embodiment described previously.

When the cover 8 is closed as illustrated in FIG. 8, the shutter member 6 is retracted from a position where the shutter member 6 covers the nozzle face 124 of the recording head 24. By contrast, when the cover 8 is opened as illustrated in FIG. 9, the shutter member 6 covers the nozzle face 124 of the recording head 24 to prevent damage to the nozzle face 124 caused by other components that may contact the nozzle face 124 upon opening of the cover 8.

Figure 10A:
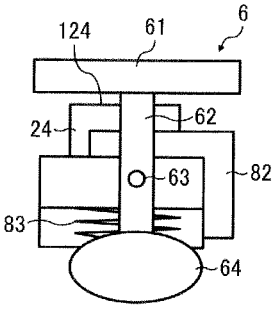
FIGS. 10A and 10B are schematic vertical cross-sectional views respectively illustrating an example of a configuration of a shutter mechanism.
Figure 10B:
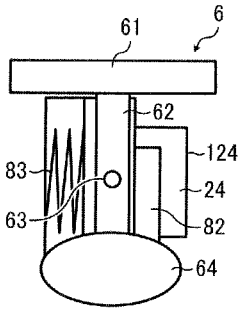

A description is now given of an example of a configuration of a shutter mechanism that includes the shutter member 6, with reference to FIGS. 10A and 10B.

FIG. 10A is a vertical cross-sectional view illustrating an example of a configuration of the shutter mechanism in the state in which the cover 8 is opened. FIG. 10B is a vertical cross-sectional view of the shutter mechanism in the state in which the cover 8 is closed.

The shutter member 6 has a protection part 61 that covers the nozzle face 124 of the recording head 24, and a supporter 62 is provided to each end of the protection part 61 in the direction perpendicular to the sheet conveyance direction. An intermediate portion of each supporter 62 is rotatably supported by a support shaft 63 provided to the cover 8, and a spindle 64 is provided to a trailing end of each supporter 62 opposite an end thereof provided to the protection part 61.

In such a configuration, the spindle 64 is constantly kept at the lower position to hold the protection part 61 at the upper position, regardless of whether the cover 8 is opened or closed as illustrated in FIGS. 10A and 10B, respectively.

When the cover 8 is closed, the recording head 24 is positioned as illustrated in FIG. 10B to eject the droplets in the horizontal direction. At this time, the protection part 61 of the shutter member 6 is positioned away from the nozzle face 124 of the recording head 24.

By contrast, when the cover 8 is opened, the nozzle face 124 of the recording head 24 faces upward as illustrated in FIG. 10A. However, the position of the protection part 61 is unchanged so that the nozzle face 124 of the recording head 24 is covered with the protection part 61 of the shutter member 6. Thus, the nozzle face 124 of the recording head 24 is protected by the protection part 61 of the shutter member 6 when the cover 8 is opened.

Although the relative positions of the nozzle face 124 of the recording head 24 and the shutter member 6 are changed by changing the orientation of the recording head 24 in the above-described example, the configuration is not limited thereto.

Alternatively, a shutter that has openings formed therein at positions corresponding to nozzles formed in the nozzle face 124 of the recording head 24 may be provided in front of the recording head 24 such that the openings of the shutter are displaced in conjunction with the opening and closing of the cover 8 to cover or uncover the nozzles.

Figure 11A:
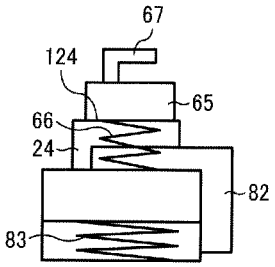
FIGS. 11A and 11B are schematic vertical cross-sectional views respectively illustrating an example of a configuration of a cap member provided to an image forming apparatus according to a sixth illustrative embodiment.
Figure 11B:
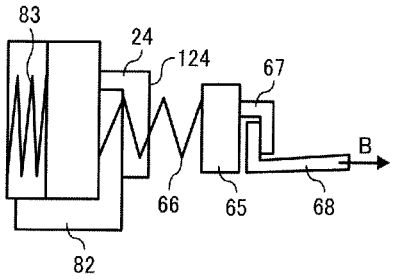

A description is now given of the image forming apparatus 1 according to a sixth illustrative embodiment, with reference to FIGS. 11A and 11B.

FIG. 11A is a schematic vertical cross-sectional view illustrating an example of a configuration of a cap member 65 provided to the image forming apparatus 1 according to the sixth illustrative embodiment in the state in which the cover 8 is opened. FIG. 11B is a schematic vertical cross-sectional view of the cap member 65 in the state in which the cover 8 is closed.

The image forming apparatus 1 according to the six illustrative embodiment 1 further includes the cap member 65 that covers the nozzle face 124 of the recording head 24 at least when the cover 8 is opened.

As illustrated in FIG. 11A, the nozzle face 124 of the recording head 24 is covered with the cap member 65 when the cover 8 is opened. At this time, the cap member 65 is pressed against the nozzle face 124 of the recording head 24 by a pressing member, which, in the present illustrative embodiment, is an elastic member 66 provided between the recording head 24 and the cap member 65.

By contrast, when the cover 8 is closed, a hook 67 provided to the cap member 65 engages a tension member 68 provided to the body of the image forming apparatus 1 as illustrated in FIG. 11B. At this time, the tension member 68 is pulled in a direction indicated by arrow B in FIG. 11B to move the cap member 65 away from the nozzle face 124 of the recording head 24, so that the recording head 24 is now ready for image formation.

Thus, in the sixth illustrative embodiment, the nozzle face 124 of the recording head 24 is covered with the cap member 65 during replacement of the recording head 24, thereby preventing damage to the nozzle face 124.

It is preferable that the cap member 65 be disposed between the first and second platens 152 and 153 included in the image forming apparatus 1 according to the third illustrative embodiment described above.

Figure 12:
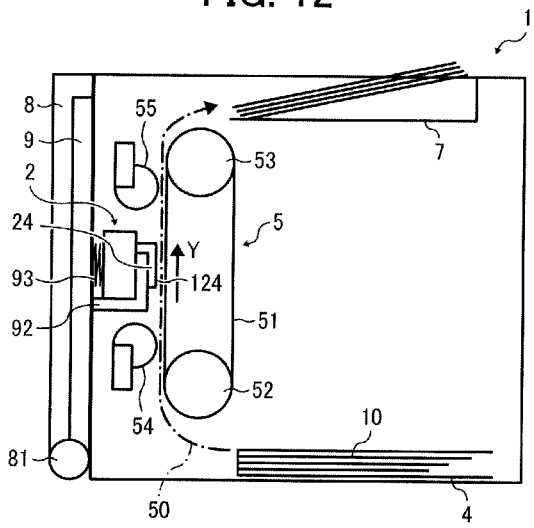
FIG. 12 is a schematic vertical cross-sectional view illustrating an example of a configuration of an image forming apparatus according to a seventh illustrative embodiment in a state in which a cover is closed.
Figure 13:
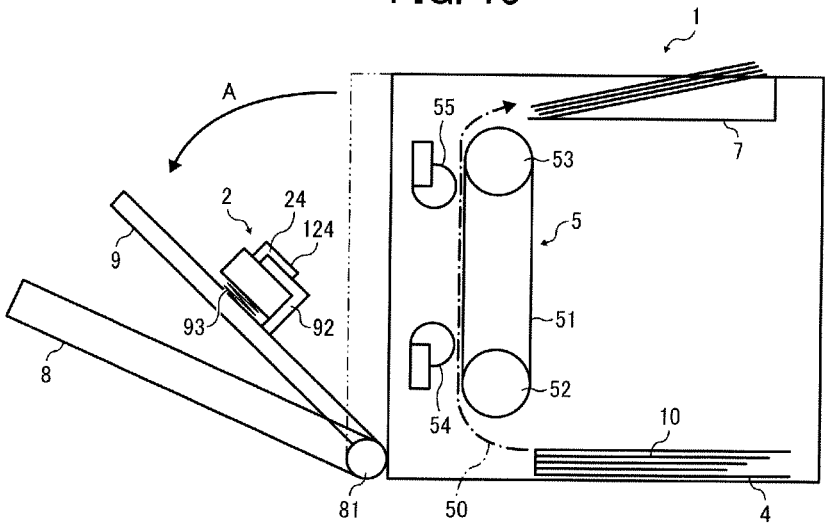
FIG. 13 is a schematic vertical cross-sectional view of the image forming apparatus illustrated in FIG. 12 in a state in which the cover is opened.

A description is now given of the image forming apparatus 1 according to a seventh illustrative embodiment, with reference to FIGS. 12 and 13.

FIG. 12 is a schematic vertical cross-sectional view illustrating an example of a configuration of the image forming apparatus 1 according to the seventh illustrative embodiment in the state in which the cover 8 is closed. FIG. 13 is a schematic vertical cross-sectional view of the image forming apparatus 1 illustrated in FIG. 12 in the state in which the cover 8 is opened.

The image forming apparatus 1 according to the seventh illustrative embodiment further includes a head supporter 9 rotatably provided between the cover 8 and the conveyance mechanism 5. Similar to the configuration in which the recording head 24 is held by the cover 8 described previously, the recording head 24 is detachably attached to a support member 92 provided to the head supporter 9. An elastic member 93 is provided between the head supporter 9 and the rear face of the recording head 24 opposite the nozzle face 124 thereof.

The head supporter 9 is moved in conjunction with the opening and closing of the cover 8. Specifically, when the cover 8 is opened as illustrated in FIG. 13, the head supporter 9 is moved in a direction in which the recording head 24 is moved away from the conveyance mechanism 5. By contrast, when the cover 8 is closed as illustrated in FIG. 12, the head supporter 9 is moved in a direction in which the recording head 24 approaches the conveyance mechanism 5.

In such a configuration, a link mechanism that couples the cover 8 to the head supporter 9 may be provided. The cover 8 is swung open alone to a predetermined angle. When the cover 8 reaches the predetermined angle, the head supporter 9 is coupled to the link mechanism so that the head supporter 9 is also swung open together with the cover 8.

As a result, the orientation of the recording head 24 during the replacement of the recording head 24 is set individually without depending on the open position of the cover 8.

In a case in which the image forming part 2 has a serial-type configuration, a carriage that mounts the recording head thereon and a drive mechanism that moves the carriage in a main scanning direction may be included in a carriage unit, so that the carriage unit may be detachably attachable to the head supporter 9. Thus, both a degree of freedom in the configuration of the image forming part 2 and handling of the cover 8 are improved.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus, comprising:

an image forming part comprising a recording head to form an image on a recording medium;

a conveyance mechanism disposed opposite the image forming part to convey the recording medium; and a cover plate closably openable relative to a body of the image forming apparatus, the cover plate being disposed opposite the conveyance mechanism with the image forming part interposed therebetween, wherein the recording head is detachable from, and attachable to, the cover plate in a direction along the surface of the cover plate.

2. The image forming apparatus according to claim 1, wherein the recording head is constructed of a liquid ejection head from which droplets are ejectable, and is attached to the cover plate to eject the droplets in a horizontal direction.

3. The image forming apparatus according to claim 2, further comprising a shutter member to cover a nozzle face of the recording head when the recording head is moved to a position away from the conveyance mechanism.

4. The image forming apparatus according to claim 2, further comprising a cap member movable to cover a nozzle face of the recording head when the recording head is moved to a position away from the conveyance mechanism.

5. The image forming apparatus according to claim 4, further comprising a pressing member provided to the image forming part to press the cap member against the nozzle face of the recording head.

6. The image forming apparatus according to claim 5, further comprising a tension member provided to the body of the image forming apparatus to move the cap member away from the nozzle face of the recording head.

7. The image forming apparatus according to claim 1, further comprising a pressing part to press the recording head toward the conveyance mechanism when the cover plate is closed.

* * * * *